US009804516B2

(12) United States Patent
Makabe et al.

(10) Patent No.: US 9,804,516 B2
(45) Date of Patent: Oct. 31, 2017

(54) TONER, DEVELOPER, IMAGE FORMING APPARATUS, AND PROCESS CARTRIDGE

(71) Applicants: Keiji Makabe, Shizuoka (JP); Tsuneyasu Nagatomo, Shizuoka (JP); Kohsuke Satoh, Shizuoka (JP); Junichi Watanabe, Shizuoka (JP); Kenji Yoneda, Shizuoka (JP); Daichi Hisakuni, Shizuoka (JP)

(72) Inventors: Keiji Makabe, Shizuoka (JP); Tsuneyasu Nagatomo, Shizuoka (JP); Kohsuke Satoh, Shizuoka (JP); Junichi Watanabe, Shizuoka (JP); Kenji Yoneda, Shizuoka (JP); Daichi Hisakuni, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/134,575

(22) Filed: Apr. 21, 2016

(65) Prior Publication Data

US 2016/0334722 A1 Nov. 17, 2016

(30) Foreign Application Priority Data

May 12, 2015 (JP) ..... 2015-097628
Mar. 10, 2016 (JP) ..... 2016-047349

(51) Int. Cl.

| | |
|---|---|
| ***G03G 9/08*** | (2006.01) |
| ***G03G 9/087*** | (2006.01) |
| *G03G 21/18* | (2006.01) |
| *G03G 15/08* | (2006.01) |

(52) U.S. Cl.

CPC ..... *G03G 9/0821* (2013.01); *G03G 9/0819* (2013.01); *G03G 9/0827* (2013.01); *G03G 9/08755* (2013.01); *G03G 9/08764* (2013.01); *G03G 15/08* (2013.01); *G03G 21/18* (2013.01)

(58) Field of Classification Search

CPC ..... G03G 9/08755; G03G 9/08764; G03G 9/0819; G03G 9/0821

See application file for complete search history.

(56) References Cited

U.S. PATENT DOCUMENTS

| | | | | |
|---|---|---|---|---|
| 2012/0189951 | A1* | 7/2012 | Sugimoto | G03G 9/0806 430/108.2 |
| 2013/0059247 | A1 | 3/2013 | Sugimoto et al. | |
| 2013/0236825 | A1* | 9/2013 | Sweeney | G03G 9/0819 430/108.11 |
| 2013/0266895 | A1* | 10/2013 | Kimura | G03G 9/0975 430/108.21 |
| 2014/0080046 | A1* | 3/2014 | Asahina | G03G 9/0821 430/105 |
| 2014/0127620 | A1* | 5/2014 | Bayley | G03G 9/09321 430/108.2 |

FOREIGN PATENT DOCUMENTS

| | | |
|---|---|---|
| JP | 2013-054178 | 3/2013 |
| JP | 2013-145369 | 7/2013 |

OTHER PUBLICATIONS

Diamond, Arthur S (editor) Handbook of Imaging Materials. New York: Marcel-Dekker, Inc. (2002) pp. 145-164.*

* cited by examiner

*Primary Examiner* — Christopher Rodee
(74) *Attorney, Agent, or Firm* — Oblon, McClelland, Maier & Neustadt, L.L.P.

(57) ABSTRACT

A toner includes a base particle; and an external additive covering the base particle. The toner includes a tetrahydrofuran (THF)-insoluble component having a glass transition temperature determined from a DSC curve when heated for the second time of from −50° C. to 10° C. and an average circularity not greater than 0.98, and satisfies the following relation:

$$Bt-0.025\times Ct\leq 1.80$$

wherein Bt represents a BET specific surface area [$m^2/g$]; and Ct represents a coverage [%] of the external additive covering the base particle.

8 Claims, 4 Drawing Sheets

TONER, DEVELOPER, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Applications Nos. 2015-097628 and 2016-047349, filed on May 12, 2015 and Mar. 10, 2016, respectively in the Japan Patent Office, the entire disclosure of which is hereby incorporated by reference herein.

BACKGROUND

Technical Field

The present invention relates to a toner, a developer, an image forming apparatus and a process cartridge.

Description of the Related Art

Recently, a toner has been required to have low-temperature fixability to save energy and heat resistant preservability against high temperature and high humidity when stored and transported after produced. Particularly, it is very important to improve low-temperature fixability because a power consumption for fixing an image occupies a large part of power consumptions in an image forming process.

In addition, the toner is required to improve in durability and cleanability as well.

SUMMARY

A toner includes a base particle; and an external additive covering the base particle. The toner includes a tetrahydrofuran (THF)-insoluble component having a glass transition temperature determined from a DSC curve when heated for the second time of from −50° C. to 10° C. and an average circularity not greater than 0.98, and satisfies the following relation:

$$Bt-0.025\times Ct\leq 1.80$$

wherein Bt represents a BET specific surface area [$m^2/g$]; and Ct represents a coverage [%] of the external additive covering the base particle.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
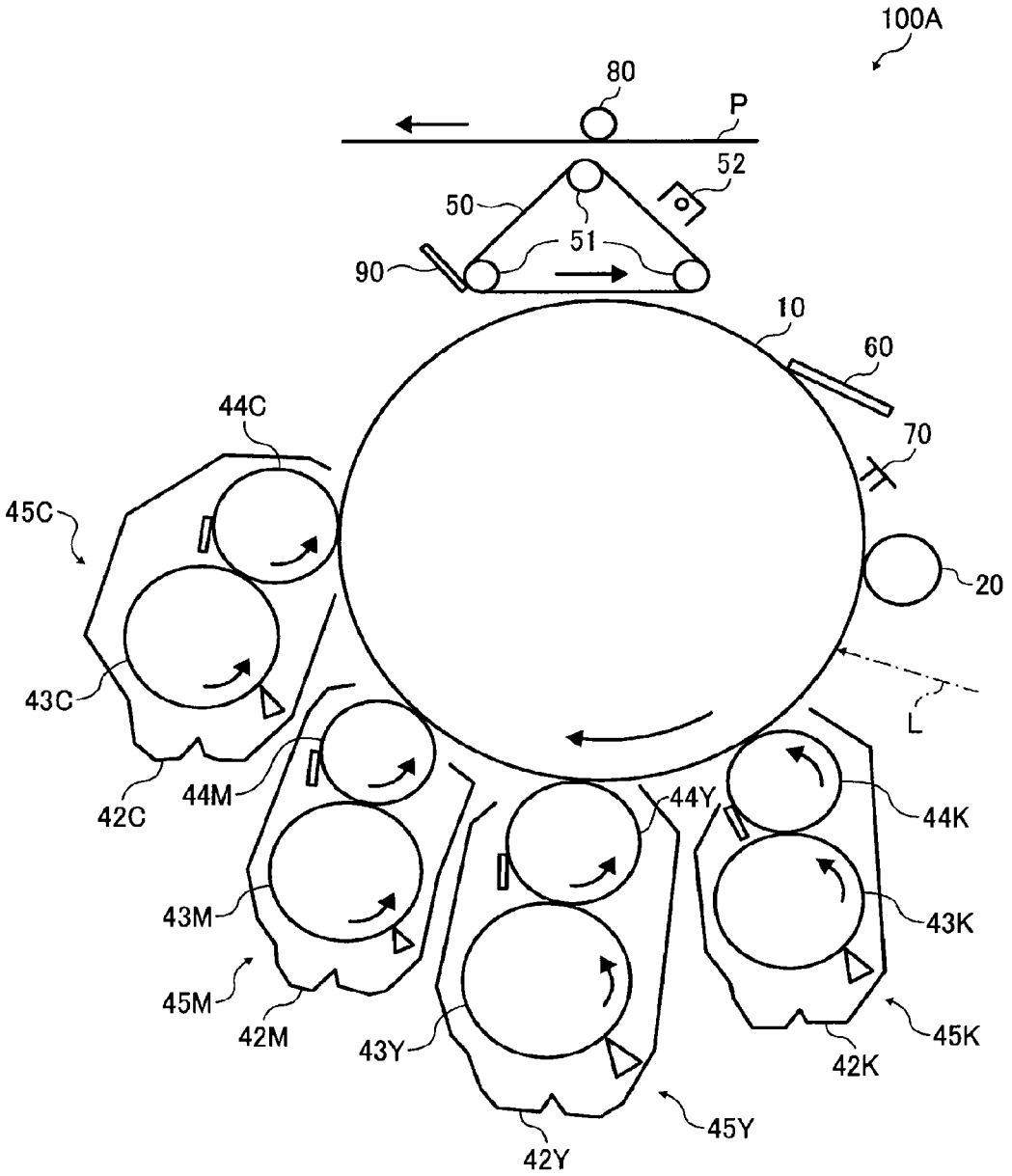
FIG. 1 is a schematic view illustrating an embodiment of the image forming apparatus of the present invention.

There is a need for providing a toner having good heat resistant preservability, low-temperature fixability, durability and cleanability.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The toner includes a base particle coated with an external additive. The toner includes a tetrahydrofuran-insoluble component preferably having a glass transition temperature $Tg_{2nd}$ determined from a DSC curve when heated for the second time of from −50° C. to 10° C., and more preferably from −30° C. to 5° C. When $Tg_{2nd}$ is less than −50° C., the toner deteriorates in heat resistant preservability. When higher than 10° C., the toner deteriorates in low-temperature fixability.

The toner typically includes polyester, preferably includes a nonlinear amorphous polyester A and an amorphous polyester B, and more preferably includes a crystalline polyester C.

The THF-insoluble component typically includes a nonlinear amorphous polyester A or a crystalline polyester C, and preferably includes a nonlinear amorphous polyester A.

The toner typically includes the THF-insoluble component in an amount of from 5% to 25% by mass to improve its low-temperature fixability and heat resistant preservability.

The amorphous polyester A has a glass transition temperature much lower than normal temperature, transforms at low temperature, transforms with heat and pressure when the toner is fixed, and adheres to a paper at lower temperature.

The amorphous polyester A preferably includes a branched structure in its molecular framework, and more preferably a urethane and/or a urea bond. Therefore, the amorphous polyester A has high aggregation energy and good adhesiveness to a paper. In addition, the amorphous polyester A having the branched structure in its molecular framework and a pseudo crosslinked point by the urethane and/or the urea bond has a molecular chain having a three-dimensional network structure, and has a rubber-like nature deforming at low temperature but not fluidizing. Therefore, the heat resistant preservability and the hot offset resistance of the toner can be improved.

Therefore, the amorphous polyester A having a glass transition temperature in an ultralow temperature range, high melt-viscosity and difficult to fluidize is combined with other binder resins in a compatible form for the toner to have low-temperature fixability and heat resistant preservability.

Having low solubility in an organic solvent, high melt-viscosity and low brittleness, the amorphous polyester A is typically difficult to granulate by dispersing in an aqueous medium or pulverizing. Therefore, the amorphous polyester A is preferably added in the form of a prepolymer having a reactive group at the molecular terminal and reacted with granulation.

The amorphous polyester A includes a constituting unit from diol and a constituting unit from dicarboxylic acid, and preferably includes a constituting unit from tri- or more valent acid and/or alcohol further. This generates rubber elasticity to improve anti-blocking.

The diol typically includes an aliphatic diol having 3 to 10 carbon atoms in an amount not less than 50% by mol.

Specific examples of the diol include, but are not limited to, aliphatic diols such as ethylene glycol, 1, 2-propylene glycol, 1, 3-propylene glycol, 1, 4-butanediol, and 1, 6-hexanediol, 1, 8-octanediol, 1, 10-decanediol and 1, 12-dodecanediol; diols having an oxy alkylene group such as diethylene glycol, triethylene glycol, dipropylene glycol, polyethylene glycol, polypropylene glycol and polytetramethylene; alicyclic diol such as 1,4-cyclohexanedimethanol and hydrogenated bisphenol A; adducts of the above-mentioned alicyclic diol with an alkylene oxide such as ethylene oxide, propylene oxide and butylene oxide; bisphenols such as bisphenol A, bisphenol F and bisphenol S; and adducts of the above-mentioned bisphenol with an alkylene oxide such as ethylene oxide, propylene oxide and butylene oxide; and their combinations. In particular, aliphatic diols having 4 to 12 carbon atoms are preferably used.

Diol preferably has an odd number of carbon atoms in the main chain, and an alkyl group in the side chain. Having high deformability in a low temperature range, the resin has rubber elasticity, and the resultant toner improves in low-temperature fixability and anti-blocking.

Specific examples of the dicarboxylic acid include, but are not limited to, aliphatic dicarboxylic acids, aromatic dicarboxylic acids and their combinations. In particular, aliphatic dicarboxylic acids having 4 to 12 carbon atoms are preferably used.

In addition, their anhydrides, lower (having 1 to 3 carbon atoms) alkyl esterified compounds and halogenated compounds may be used.

Specific examples of the aliphatic dicarboxylic acid include, but are not limited to, succinic acid, adipic acid, sebacic acid, dodecanedioic acid, maleic acid and fumaric acid.

Specific examples of the aromatic dicarboxylic acid include, but are not limited to, phthalic acid, isophthalic acid, terephthalic acid and naphthalene dicarboxylic acid. Specific examples of the tri- or higher valent aliphatic alcohol include, but are not limited to, glycerin, trimethylolethane, trimethylolpropane (TMP), pentaerythritol, sorbitol, dipentaerythritol, trimellitic acid (TMA), pyromellitic acid and their combinations. In Particular, trivalent acid or alcohol is preferably used because the resin has rubber elasticity while having high deformability in a low temperature range, and the resultant toner improves in low-temperature fixability and anti-blocking.

The amorphous polyester A having a urethane bond and/or a urea bond is synthesized by reacting an amorphous polyester prepolymer A having an isocyanate group with a compound having an active hydrogen group.

The amorphous polyester prepolymer A having an isocyanate group is synthesized by reacting an amorphous polyester having an active hydrogen group and polyisocyanate.

The polyisocyanate is not particularly limited. Examples thereof include diisocyanate, tri- or higher valent isocyanate and their combinations.

Instead of the polyisocyanate, the polyisocyanate blocked with a phenol derivative, oxime, caprolactam, etc. may be used.

Specific examples of the diisocyanate include, but are not limited to, aliphatic diisocyanate, alicyclic diisocyanate, aromatic diisocyanate, aromatic aliphatic diisocyanate and isocyanurate.

Specific examples of the aliphatic diisocyanate include, but are not limited to, tetramethylene diisocyanate, hexamethylene diisocyanate, 2, 6-diisocyanato methyl caproate, octamethylene diisocyanate, decamethylene diisocyanate, dodecamethylene diisocyanate, tetra decamethylene diisocyanate, trimethyl hexane diisocyanate and tetramethyl hexane diisocyanate.

Specific examples of the alicyclic diisocyanate include, but are not limited to, isophorone diisocyanate and cyclohexylmethane diisocyanate.

Specific examples of the aromatic diisocyanate include, but are not limited to, tolylene diisocyanate, diisocyanato diphenyl methane, 1, 5-nephthylene diisocyanate, 4, 4'-diisocyanato diphenyl, 4, 4'-diisocyanato-3, 3'-dimethyldiphenyl, 4, 4'-diisocyanato-3-methyl diphenyl methane and 4, 4'-diisocyanato-diphenyl ether.

Specific examples of the aromatic aliphatic diisocyanate include, but are not limited to, α, α, α', α'-tetramethylxylene diisocyanate.

Specific examples of the isocyanurate include, but are not limited to, tris(isocyanatoalkyl)isocyanurate and tris(isocyanatocycloalkyl)isocyanurate.

Specific examples of the active hydrogen group include, but are not limited to, a hydroxyl group (e.g., an alcoholic hydroxyl group, and a phenolic hydroxyl group), an amino group, a carboxyl group, a mercapto group and their combinations.

A compound including an active hydrogen group is preferably amine because it can form a urea bond.

Specific examples of the amine include, but are not limited to, diamine, trivalent or higher amine, amino alcohol, amino mercaptan, amino acid and their combinations.

Instead of the amine, ketimine, oxazoline, etc. which are amines the amino group of which are blocked with ketones such as acetone, methyl ethyl ketone and methyl isobutyl ketone may be used.

Among them, diamine, and a mixture of diamine and a small amount of tri- or higher valent amine are preferably used.

Specific examples of the diamine include, but are not limited to, aromatic diamine, alicyclic diamine and aliphatic diamine.

Specific examples of the aromatic diamine include, but are not limited to, phenylenediamine, diethyl toluene diamine and 4, 4'-diaminodiphenylmethane.

Specific examples of the alicyclic diamine include, but are not limited to, 4, 4'-diamino-3, 3'-dimethyldicyclohexyl methane, diamino cyclohexane and isophoronediamine.

Specific examples of the aliphatic diamine include, but are not limited to, ethylene diamine, tetramethylene diamine and hexamethylenediamine.

Specific examples of the tri- or higher valent amine include, but are not limited to, diethylenetriamine and triethylene tetramine.

Specific examples of the amino alcohol include, but are not limited to, ethanol amine and hydroxyethyl aniline.

Specific examples of the amino mercaptan include, but are not limited to, aminoethyl mercaptan and aminopropyl mercaptan.

Specific examples of the amino acid include, but are not limited to, amino propionic acid and amino caproic acid.

A molecular structure of the amorphous polyester can be confirmed by solution-state or solid-state NMR, X-ray diffraction, GC/MS, LC/MS, or IR spectroscopy. Simple methods for confirming the molecular structure thereof include a method for detecting, as the polyester resin, one that does not have absorption based on δCH (out-of-plane bending vibration) of olefin at 965 cm±10 $cm^{-1}$ and 990 cm±10 $cm^{-1}$ in an infrared absorption spectrum.

The amorphous polyester A typically has a glass transition temperature $Tg_{2nd}$ determined from a DSC curve when heated for the second time of from −60° C. to 0° C. to improve heat resistant preservability, filming resistance and low-temperature fixability of the resultant toner.

The amorphous polyester A typically has a weight-average molecular weight of from 20,000 to 1,000,000, preferably from 50,000 to 300,000, and more preferably from 100,000 to 200,000 to improve heat resistant preservability, hot offset resistance and low-temperature fixability of the resultant toner.

The toner typically includes the amorphous polyester A in an amount of from 5% to 20% by mass, and preferably from 5% to 15% by mass to improve low-temperature fixability, hot offset resistance and heat resistant preservability of the resultant toner, and glossiness of images produced therewith.

The amorphous polyester B is preferably linear amorphous polyester.

The amorphous polyester B is preferably unmodified amorphous polyester.

The unmodified amorphous polyester B is synthesized by reacting a polyol with a polycarboxylic acid.

Instead of the polycarboxylic acid, a polycarboxylic acid anhydride, a lower alkyl ester having 1 to 3 carbon atoms or a halogenated compound may be used.

Examples of the polyol include, but are not limited to, diols.

Specific examples of the diols include, but are not limited to, alkylene (having 2 to 3 carbon atoms) oxide (average addition molar number is 1 to 10) adduct of bisphenol A such as polyoxypropylene(2. 2)-2, 2-bis(4-hydroxyphenyl)propane, and polyoxyethylene(2. 2)-2, 2-bis(4-hydroxyphenyl) propane; ethyleneglycol, propyleneglycol; and hydrogenated bisphenol A, and alkylene (having 2 to 3 carbon atoms) oxide (average addition molar number is 1 to 10) adduct of hydrogenated bisphenol A and their combinations.

Examples of the polycarboxylic acid include, but are not limited to, dicarboxylic acid.

Specific examples of the dicarboxylic acid include, but are not limited to, adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid, octylsuccinic acid and their combinations.

The dicarboxylic acid preferably includes a terephthalic acid in an amount not less than 50% by mol to improve heat resistant preservability of the resultant toner.

The amorphous polyester B may include a tri- or higher valent carboxylic acid and/or a tri- or higher valent alcohol at the end of the resin chain to adjust an acid value and a hydroxyl value.

Specific examples of the tri- or higher valent carboxylic acid include, but are not limited to, trimellitic acid, pyromellitic acid and their combinations.

Specific examples of the tri- or higher valent alcohol include, but are not limited to, glycerin, pentaerythritol, trimethylol propane and their combinations.

The amorphous polyester B typically has a weight-average molecular weight of from 3,000 to 10,000, and preferably from 4,000 to 7,000 to improve heat resistant preservability, durability and low-temperature fixability of the resultant toner.

The amorphous polyester B typically has an acid value of from 1 to 50 mg KOH/g, and preferably from 5 to 30 mg KOH/g. When the acid value thereof is not less than 1 mg KOH/g, the resultant toner is negatively charged and low-temperature fixability thereof is improved. When not greater than 50 mg KOH/g, charge stability, especially charge stability against environmental change of the resultant toner is improved.

The amorphous polyester B typically has a hydroxyl value not less than 5 mg KOH/g.

The amorphous polyester B typically has a glass transition temperature of from 40° C. to 80° C., and preferably from 50° C. to 70° C. When the glass transition temperature thereof is not less than 40° C., heat resistant preservability, durability and filming resistance of the resultant toner are improved. When not greater than 80° C., low-temperature fixability of the resultant toner is improved.

The toner typically includes the amorphous polyester B of from 50% to 90% parts by mass, and preferably from 60% to 80% by mass. When not less than 50% by mass, production of foggy and artifacting images is suppressed. When not greater than 90% by mass, low-temperature fixability of the resultant toner is improved.

Having high crystallinity, the crystalline polyester C has heat meltability quickly having viscosity at around a fixation starting temperature. When the crystalline polyester C having such properties is used together with the amorphous polyester B, the toner has good heat resistant preservability due to crytallinity just before a melt starting temperature. At the melt starting temperature, the toner quickly decreases in viscosity (sharp meltability) due to melting of the crystalline polyester C. Then, the crystalline polyester C is compatible with an amorphous polyester B, and they quickly decrease in viscosity together to obtain a toner having good heat resistant preservability and low-temperature fixability. In addition, a release width (a difference between a fixable minimum temperature and a temperature at which hot offset occurs) has a good result.

The crystalline polyester C is not modified and synthesized by reacting a polyol with a polycarboxylic acid.

Instead of the polycarboxylic acid, a polycarboxylic acid anhydride, a lower alkyl ester having 1 to 3 carbon atoms or a halogenated compound may be used.

Examples of the polyol include, but are not limited to, diols, tri- or higher valent alcohols and their combinations.

Specific examples of the diol include saturated aliphatic diol, etc.

Specific examples of the saturated aliphatic diol include straight chain saturated aliphatic diol, and branched-chain saturated aliphatic diol. Among them, straight chain saturated aliphatic diol is preferably used to increase crystallinity of the crystalline polyester C, and straight chain saturated aliphatic diol having 2 to 12 carbon atoms is more preferably used because of easily be obtainable.

Specific examples of the saturated aliphatic diol include ethylene glycol, 1, 3-propanediol, 1, 4-butanediol, 1, 5-pentanediol, 1, 6-hexanediol, 1, 7-heptanediol, 1, 8-octanediol, 1, 9-nonanediol, 1, 10-decanediol, 1, 11-undecanediol, 1, 12-dodecanediol, 1, 13-tridecanediol, 1, 14-tetradecanediol, 1, 18-octadecanediol, 1, 14-eicosanedecanediol, etc. Among them, ethylene glycol, 1, 4-butanediol, 1, 6-hexanediol, 1, 8-octanediol, 1, 10-decanediol, and 1, 12-dodecanediol are preferably used because of giving high crystallinity and excellent sharp melt properties to the resultant crystalline polyester C.

Specific examples of the tri- or higher valent alcohol include glycerin, trimethylol ethane, trimethylolpropane, pentaerythritol, etc.

The polycarboxylic acid is not particularly limited and may be appropriately selected depending on the intended purpose. Examples thereof include divalent carboxylic acid, and tri- or higher valent carboxylic acid.

Specific examples of the divalent carboxylic acid include, but are not limited to, saturated aliphatic dicarboxylic acids such as an oxalic acid, a succinic acid, a glutaric acid, an adipic acid, a suberic acid, an azelaic acid, a sebacic acid, a 1, 9-nonanedicarboxylic acid, a 1, 10-decanedicarboxylic acid, a 1, 12-dodecanedicarboxylic acid, a 1, 14-tetradecanedicarboxylic acid, and a 1, 18-octadecanedicarboxylic acid; aromatic dicarboxylic acids of dibasic acid such as a phthalic acid, an isophthalic acid, a terephthalic acid, a naphthalene-2, 6-dicarboxylic acid, a malonic acid, a and mesaconic acid; and anhydrides of the foregoing compounds, and lower (having 1 to 3 carbon atoms) alkyl ester of the foregoing compounds.

Specific examples of the tri- or higher valent carboxylic acid include, but are not limited to, 1, 2, 4-benzenetricarboxylic acid, 1, 2, 5-benzenetricarboxylic acid, 1, 2, 4-naphthalene tricarboxylic acid, anhydrides thereof, and lower (having 1 to 3 carbon atoms) alkyl esters thereof.

The polycarboxylic acid may include a dicarboxylic acid having a sulfonic acid group.

Further, the polycarboxylic acid may include a dicarboxylic acid having a (carbon-to-carbon) double bond.

The crystalline polyester C preferably includes a constitutional unit of a straight chain saturated aliphatic dicarboxylic acid having 4 to 12 carbon atoms and a constitutional unit of a straight chain saturated aliphatic diol having 2 to 12 carbon atoms. As a result of this, the crystalline polyester C has high crystallinity and good sharp meltability, and the resultant toner has good low-temperature fixability.

The crystalline polyester C typically has a melting point of from 60° C. to 90° C., and preferably from 60° C. to 80° C. When not less than 60° C., heat resistant preservability of the resultant toner is improved. When not greater than 90° C., low-temperature fixability of the resultant toner is improved.

The crystalline polyester C typically has a weight-average molecular weight of from 3,000 to 30,000, and preferably from 5,000 to 15,000. When not less than 3,000, heat resistant preservability of the resultant toner is improved. When not greater than 30,000, low-temperature fixability of the resultant toner is improved.

The crystalline polyester C typically has an acid value not less than 5 mg KOH/g, and preferably not less than 10 mg KOH/g to improve low-temperature fixability of the resultant toner. Meanwhile, the crystalline polyester C typically has an acid value not greater than 45 mg KOH/g to improve hot offset resistance of the resultant toner.

The crystalline polyester C typically has a hydroxyl value not greater than 50 mg KOH/g, and preferably from 5 to 50 mg KOH/g to improve low-temperature fixability and charge property of the resultant toner.

A molecular structure of the crystalline polyester C can be confirmed by solution-state or solid-state NMR, X-ray diffraction, GC/MS, LC/MS, or IR spectroscopy. Simple methods for confirming the molecular structure thereof include a method for detecting, as a crystalline polyester resin, one that has absorption based on δCH (out-of-plane bending vibration) of olefin at 965 cm±10 $cm^{-1}$ and 990 cm±10 $cm^{-1}$ in an infrared absorption spectrum.

The toner typically includes the crystalline polyester C in an amount of from 3% to 20% by mass, and preferably from 5% to 15% by mass to improve low-temperature fixability and heat resistant preservability of the resultant toner, and suppress production of foggy images.

The external additive is not particularly limited. Examples thereof include oxide particles such as silica particles, titania particles, alumina particles, tin oxide particles and antimony trioxide particles; aliphatic acid metal salts such as zinc stearate and aluminum stearate; and fluoropolymer particles. Among them, hydrophobized silica, titania, titanium oxide and alumina are preferably used.

Examples of the commercially available silica particles include R972, R974, RX200, RY200, R202, R805, and R812 (all products of Nippon Aerosil Co., Ltd.), etc.

Examples of the commercially available titania particles include P-25 (product of Nippon Aerosil Co., Ltd.); STT-30, STT-65C-S (both products of Titan Kogyo, Ltd.); TAF-140 (product of Fuji Titanium Industry Co., Ltd.); and MT-150W, MT-500B, MT-600B, MT-150A (all product of TAYCA CORPORATION), etc.

Examples of the hydrophobized titanium oxide particles include T-805 (product of Nippon Aerosil Co., Ltd.); STT-30A, STT-65S-S (both products of Titan Kogyo, Ltd.); TAF-500T, TAF-1500T (both products of Fuji Titanium Industry Co., Ltd.); MT-100S, MT-100T (both products of TAYCA CORPORATION); and IT-S (product of ISHIHARA SANGYO KAISHA, LTD.), etc.

Specific examples of methods of hydrophobizing oxide particles include, but are not limited to, treating the oxide particles with a silane coupling agent such as methyltrimethoxy silane, methyltriethoxy silane, and octyltrimethoxy silane; and heating with an silicone oil such as dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

The toner typically includes the external additive in an amount of from 0.1% s to 5% by mass, and preferably from 0.3% to 3% by mass.

The oxide particles typically have an average primary particle diameter of from 1 to 100 nm, and preferably from 3 to 70 nm to suppress the oxide particles from being buried in the base particles and nonuniform damages on the surface of a photoconductor.

The toner may further include a release agent, a colorant, a charge controlling agent, an external additive, a fluidity improver, a cleanability improver, a magnetic material, etc. Specific examples of the release agent include, but are not limited to, vegetable wax such as carnauba wax, cotton wax, Japan wax and rice wax; animal wax such as bees wax and lanolin; mineral wax such as ozokelite and ceresine; petroleum wax such as paraffin wax, microcrystalline wax and petrolatum; hydrocarbon wax such as Fischer-Tropsch wax and polyethylene wax; synthetic wax such as ester wax, ketone wax and ether wax; fatty acid amides such as 12-hydroxystearic acid amide, stearic amide and phthalic anhydride imide. Among them, a hydrocarbon wax such as a paraffin wax, a microcrystalline wax, a Fischer-Tropsch wax, a polyethylene wax, and a polypropylene wax is preferably used.

The release agent typically has a melting point of from 60° C. to 80° C. When not less than 60° C., heat resistant preservability of the resultant toner is improved. When not greater than 80° C., hot offset resistance of the resultant toner is improved.

The toner typically includes the release agent in an amount of from 2% to 10% by mass, and preferably from 3% to 8% by mass. When not less than 2% by mass, the resultant toner improves in hot offset resistance and low-temperature fixability. When not greater than 10% by mass, the resultant toner improves in heat resistant preservability and suppresses production of foggy image.

Specific examples of the colorant include, but are not limited to, carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and their combinations.

The toner typically includes the colorant in an amount of from 1% to 15% s by mass, and preferably from 3% to 10% by mass.

The colorant may be combined with a resin and used as a masterbatch.

Specific examples of the resin include, but are not limited to, polymers of styrene or substitution thereof such as the amorphous polyester B, polystyrene, poly-p-chlorostyrene, and polyvinyl toluene; styrene copolymers such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer; and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, and their combinations.

The masterbatch can be prepared by mixing and kneading the colorant with the resin. Then, an organic solvent may be used for improving the interactions between the colorant and the resin.

Moreover, the masterbatch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant.

Apparatuses for mixing and kneading of the colorant and the resin are not particularly limited, and a high-shearing disperser such as a three-roll mill is preferably used.

Specific examples of the cleanability improver include, but are not limited to, fatty acid metal salt such as zinc stearate, calcium stearate, and stearic acid; and polymer particles produced by soap-free emulsion polymerization, such as polymethyl methacrylate particles, and polystyrene particles.

The polymer particles typically have a volume-average particle diameter of from 0.01 to 1 μm.

Specific examples of the magnetic material include, but are not limited to, iron powder, magnetite, and ferrite. Among them, a white magnetic material is preferably used in terms of a color tone.

The toner typically has a number-average particle diameter of from 3.0 to 8.0 μm to lower nonelectrostatic adherence of the toner to an intermediate transferer and improve transfer efficiency. In addition, an electrostatic latent image is faithfully developed and high-resolution and high-quality image are produced.

The toner preferably has an average circularity not greater than 0.98, and more preferably not greater than 0.97 to improve cleanability thereof and not to remain on a photoconductor. A toner typically has an average circularity not less than 0.92.

Methods of controlling the average circularity of a toner include, but are not limited to, heating, controlling viscosity of oil drops, and controlling association number of oil drops.

The toner preferably satisfies the following relation:

$$Bt-0.025\times Ct\leq 1.80, \text{ and}$$

more preferably the following relation:

$$Bt-0.025\times Ct\leq 1.20,$$

wherein Bt represents a BET specific surface area [$m^2/g$]; and Ct represents a coverage [%] of the external additive covering the base particle.

When greater than 1.80, the toner deteriorates in durability and produce stripe images. Bt−0.025×Ct is typically not less than 0.80.

The BET specific surface area of the toner includes concavities and convexities on the surfaces of the base particle and the external additive. When the toner has a coverage [%] Ct % when covered with an external additive having a BET specific surface area about 20 to 200 $m^2/g$, an increase of the BET specific surface area of the toner relative to the BET specific surface area of the base particle is about 0.025×Ct $m^2/g$. Therefore, Bt−0.025×Ct estimates the BET specific surface area. The BET specific surface area is effectively used to detect microscopic concavities and convexities on a surface, and Bt−0.025×Ct is a parameter of the surface smoothness of the base particle.

When the surface smoothness of the base particle is improved, fluidity of the developer is maintained to improve durability of the toner. This is not clarified, but the microscopic concavities and convexities decreases on the base particle, it is thought that the contact area of the toner when contacting another toner decreases to decrease nonelectrostatic adherence, and that burying speed of the external additive in the base particle is decreases.

Specific examples of methods of improving the surface smoothness of the base particle include, but are not limited to, heating.

For example, when the base particles do not aggregate with each other, i.e., when they are dispersed in an aqueous medium, they are heated at a temperature not higher than a glass transition temperature of the binder resin to decrease microscopic concavities and convexities decreases on the surface of the base particle and improve the surface smoothness thereof.

In an environment of 32° C. and 40% RH, the toner preferably satisfies the following relation when a load reaches $3.00\times10^{-4}$N at a load speed of $3.0\times10^{-5}$N/sec to be difficult to deform with a pressure stress in an image develop and improve durability:

$$X/Dn\leq0.14$$

wherein X represents an average of deformation quantity [μm]; and Dn represents a number-average particle diameter [μm].

X/Dn is typically not greater than 0.06.

Specific examples of methods of producing the toner include, but are not limited to, dissolution suspension methods.

The toner is preferably prepared by emulsifying or dispersing an oil phase in an aqueous medium, where the oil phase contains at least the amorphous polyester prepolymer A having an isocyanate group and the amorphous polyester B, and the crystalline polyester C, and the release agent and the colorant if necessary.

Resin particles are preferably dispersed in the aqueous medium.

Specific examples of resins forming the resin particles include, but are not limited to if dispersible in the aqueous medium, vinyl resins, polyurethane, epoxy resins, polyester, polyamide, polyimide, silicon resins, phenol resins, melamine resins, urea resins, aniline resins, ionomer resins, polycarbonate and their combinations. Among these, vinyl resins, polyurethane, epoxy resins and polyester are preferably used because of being capable of forming microscopic spherical resin particles.

The aqueous medium typically includes the resin particles in a mass ratio of form 0.005 to 0.1.

The aqueous medium is not particularly limited, and includes water, a solvent miscible with water, and their combinations. Among them, water is preferably used.

The solvent miscible with water is not particularly limited, and includes alcohol, dimethyl formamide, tetrahydrofuran, cellosolve, and lower ketone.

The alcohol includes methanol, isopropanol, ethylene glycol, etc.

The lower ketone includes acetone, methyl ethyl ketone, etc.

Preparation of the oil phase containing the toner materials can be performed by dissolving or dispersing toner materials in an organic solvent, where the toner materials contain at least the amorphous polyester prepolymer A having an isocyanate group and the amorphous polyester B, and the crystalline polyester C, and the release agent and the colorant if necessary.

The organic solvent typically has a boiling point less than 150° C. to easily be removed.

Specific examples of the organic solvent include, but are not limited to, toluene, xylene, benzene, carbon tetrachloride, methylene chloride, 1, 2-dichloroethane, 1, 1, 2-trichloroethane, trichloroethylene, chloroform, monochlorobenzene, dichloroethylidene, methyl acetate, ethyl acetate, methyl ethyl ketone, methyl isobutyl ketone and their combinations. Among them, ethyl acetate, toluene, xylene, benzene, methylene chloride, 1, 2-dichloroethane, chloroform, and carbon tetrachloride are particularly preferable, and ethyl acetate is more preferably used.

When the oil phase is emulsified or dispersed in an aqueous medium, the amorphous polyester prepolymer A having an isocyanate group is reacted with a compound having an active hydrogen group to prepare the amorphous polyester A.

The amorphous polyester A can be formed by, e.g., the following methods (1) to (3).

(1) A method of emulsifying or dispersing an oil phase including the non-linear reactive precursor and the curing agent in an aqueous medium and subjecting them to an elongation and/or a crosslinking reaction to form the amorphous polyester A.

(2) A method of emulsifying or dispersing an oil phase including the non-linear reactive precursor in an aqueous medium the curing agent is previously added to and subjecting them to an elongation and/or a crosslinking reaction to form the amorphous polyester A.

(3) A method of emulsifying or dispersing an oil phase including the non-linear reactive precursor in an aqueous medium, and then adding the curing agent in the aqueous medium and subjecting them to an elongation and/or a crosslinking reaction from a particle interface to form the amorphous polyester A.

When the curing agent and the non-linear reactive precursor are subject to an elongation and/or a crosslinking reaction from a particle interface, the amorphous polyester A is preferentially formed on the surface of the toner, and density gradient of the amorphous polyester A can be formed in the toner.

The compound having an active hydrogen group is typically reacted with the amorphous polyester prepolymer A having an isocyanate group for 10 min to 40 hrs, and preferably for 2 hrs to 24 hrs.

The compound having an active hydrogen group is typically reacted with the amorphous polyester prepolymer A at from 0° C. to 150° C., and preferably from 40° C. to 98° C. under pressure.

A catalyst can be used when the compound having an active hydrogen group is reacted with the amorphous polyester prepolymer A.

Specific examples of the catalyst include, but are not limited to, dibutyltinoxide and dioctyltinoxide.

Methods of emulsifying or dispersing the oil phase in the aqueous medium are not particularly limited, and include a method of adding the oil phase to the aqueous medium and dispersing the oil phase with shear force, etc.

Dispersers used for emulsifying or dispersing the oil phase in the aqueous medium are not particularly limited, and include a low-speed shearing disperser, a high-speed shearing disperser, a friction disperser, a high-pressure jetting disperser, an ultrasonic wave disperser, etc. Among them, the high-speed shearing disperser is preferably used because of being capable of controlling the particle diameter of the dispersed element (oil droplet) in a range of from 2 to 20 μm.

When the high-speed shearing disperser is used, the rotational speed is typically from 1,000 to 30,000 rpm, and preferably from 5,000 to 20,000 rpm. The dispersion time is not typically from 0.1 to 5 min in case of a batch system. The dispersion temperature is typically from 0° C. to 150° C., and preferably from 40° C. to 98° C. under pressure.

A mass ratio of the aqueous medium to the toner material is typically from 0.5 to 20, and preferably from 1 to 10 to suitably and economically disperse the oil phase.

When the oil phase is emulsified or dispersed, a dispersant is preferably used for the purpose of improving dispersion stability of the oil droplets, and giving a sharp particle size distribution as well as giving desirable shapes of base particles.

The dispersant is not particularly limited, and includes a surfactant, a water-insoluble inorganic compound dispersant, a polymer protective colloid and their combinations, etc. Among them, the surfactant is preferably used.

The surfactant includes an anionic surfactant, a cationic surfactant, a nonionic surfactant, an amphoteric surfactant, etc. Among them, those having a fluoroalkyl group are preferably used.

The anionic surfactant includes alkyl benzene sulfonic acid salts, α-olefin sulfonic acid salts, phosphoric acid esters, etc.

After the oil phase is dispersed in the aqueous medium, the organic solvent is removed to form base particles.

Methods of removing the organic solvent are not particularly limited, and include a method in which an entire reaction system is gradually heated to evaporate out the organic solvent in the oil droplets; a method in which the dispersion liquid is sprayed in a dry atmosphere to remove the organic solvent in the oil droplets, etc.

As the base particles are washed, they are preferably dried. Then, they may be classified. The classification may be carried out in the aqueous medium by removing small particles from the base particles by cyclone, a decanter, or centrifugal separator, or may be performed on the base particles after dried.

The obtained base particles are mixed with an external additive, and a charge controlling agent when necessary to prepare a toner. At this time, applying a mechanical impact during mixing suppresses the external additive from falling off from the surfaces of base particles.

Specific examples of methods of applying a mechanical impact include, but are not limited to, a method of applying an impact to the particles with a blade rotating at high speed, and a method of placing the particles in a high-speed airstream and accelerating them to collide with each other or an impact plate.

Marketed apparatuses applying an impact to the particles include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.), an automatic mortar, etc.

A developer of the present invention includes at least the toner, and further includes other components such as carrier when necessary.

The developer may be a one-component developer or a two-component developer.

The carrier typically includes a core and a protection layer covering the core.

Materials of the core are not particularly limited, and include high-magnetization materials such as a manganese-strontium material having a mass magnetization of from 50 to 90 emu/g, a manganese-magnesium material having a mass magnetization of from 50 to 90 emu/g, iron having a mass magnetization not less than 100 emu/g and magnetite having a mass magnetization of from 75 to 120 emu/g; low-magnetization materials such as a copper-zinc material having a mass magnetization of from 30 to 80 emu/g; and their combinations.

The core material typically has a volume-average particle diameter of from 10 to 150 μm, and preferably from 40 to 100 μm.

The two-component developer typically includes the carrier in an amount of from 90% to 98% by mass, and preferably from 93% to 97% by mass.

Fluidity of the developer can be evaluated by measuring total energy with a powder rheometer. The powder rheometer is explained.

Since measurement of fluidity of particles is influenced by more elements than when fluidity of a liquid, a solid or a gas is measured, it is difficult to precisely specify fluidity of particles with conventional parameters such as particle diameters and shapes. It is difficult to even decide the measurement elements because the elements actually may not influence on the fluidity so much or the elements deserve to measure only when combined with other elements.

Further, fluidity of particles is noticeably different due to outer environmental factors. For example, liquids do not change in fluidity so much even when the measurement environment changes while particles largely change in fluidity due to outer environmental factors such as humidity and a gas in which the particles flow. Since it is not clarified which measurement factors are influenced by such outer environmental factors, reproducibility of the measured value is poor in fact even when measured under strict measuring conditions.

A repose angle and a bulk density have been used as parameters of fluidity of a toner in a tank. These are indirect relative to fluidity and it is difficult to quantitate fluidity.

However, the powder rheometer is capable of measuring a total energy applied to the rotational blade of the measurer from a developer to obtain a sum of each factor arising from fluidity. Therefore, the powder rheometer is capable of directly measuring fluidity without conventionally deciding subjects to be measured and measuring optimum physical properties thereof on a developer the surface properties and the particle diameter distribution of which have been controlled. As a result, the powder rheometer can decide whether a developer can suitably be used for developing an electrostatic latent image only by measuring the total energy. It is much more practical to maintain fluidity of a developer using the rheometer than to maintain with conventional indirect values. Further, the rheometer is easy to have constant measuring conditions and has high reproducibility of measured values. Namely, a method of specifying fluidity with a total energy is more simple, precise and reliable than conventional methods.

The powder rheometer is a fluidity measurer directly measuring fluidity by spirally rotating a blade in filled particles to measure a rotational torque and a vertical load at the same time. Measuring both of the rotational torque and the vertical load can high sensitively detect fluidity including properties of the particles and influences of outer environment. After status of the filled particles is stabilized, the total energy is measured to obtain data having good reproducibility.

The total energy of a developer, measured by a powder rheometer in which a container has a capacity of 25 mL, a propeller-shaped rotational blade has a tip speed of 10 mm/s, and an intrusion angle thereof is −5°, is typically from 200 to 350 mJ, and preferably from 200 to 300 mJ to suppress a developer from ejecting from a developer bearer and contaminating the inside of the image forming apparatus, and to improve durability of the toner.

The total energy of 30 g of a developer after stirred and mixed by a locking mill at 700 rpm for 60 min is typically from 200 to 350 mJ, and preferably from 200 to 300 mJ to suppress a developer from ejecting from a developer bearer and contaminating the inside of the image forming apparatus, and to improve durability of the toner.

The developer is typically contained in known containers.

The container is not particularly limited, and includes those having a cap and a container main body, etc.

A shape of the container main body is not particularly limited, and includes a cylindrical shape, etc.

The inner surface of the main body preferably has spirally-arranged concavo-convex portions some or all of which can accordion and in which the developer can be transferred to an outlet port through rotation.

Materials for the main body are not particularly limited, and include polyester resins, polyethylene resins, polypropylene resins, polystyrene resins, polyvinyl chloride resins, polyacrylic acids, polycarbonate resins, ABS resins, polyacetal resins, etc.

The above developer accommodating container is excellent in easiness of storage and transportation and handling of the container. Therefore, it can be detachably attached to the below-described process cartridge and image forming apparatus, and can be used for supplying a developer.

The developer can be used in known image forming apparatuses forming images by electrophotographic methods such as magnetic one-component developing methods, FIG. 1 is a schematic view illustrating an embodiment of the image forming apparatus of the present invention.

An image forming apparatus 100A includes a photoconductor drum 10, a charging roller 20, an irradiator (unillustrated), image developers 45 (K, Y, M and C), an intermediate transfer belt 50, a cleaner 60 including a cleaning blade, and a discharge lamp 70.

The intermediate transfer belt 50 is stretched around three rollers 51 disposed in the belt, and is designed to be movable in a direction indicated by the arrow. A part of the three rollers 51 also functions as a transfer bias roller which can apply a predetermined transfer bias to the intermediate transfer belt 50.

Near the intermediate transfer belt 50, a cleaner 90 including a cleaning blade is disposed. Also, a transfer roller 80 capable of applying a transfer bias for transferring a toner image onto a recording paper P is disposed facing the intermediate transfer belt 50.

Around the intermediate transfer belt 50, a corona charger 52 for applying a charge to the toner image on the intermediate transfer belt 50 is disposed between a contact portion of the photoconductor 10 with the intermediate transfer belt 50 and a contact portion of the intermediate transfer belt 50 with the recording paper P.

Image developers for each of black (K), yellow (Y), magenta (M) and cyan (C) colors includes developer containers 42 (K, Y, M and C), developer feed rollers 43 and developing rollers 44.

In the color image forming apparatus 100A, after the photoconductor drum 10 is uniformly charged by the charging roller 20, the irradiator (not illustrated) irradiates the photoconductor drum 10 with light L to form an electrostatic latent image. Next, after the electrostatic latent image formed on the photoconductor drum 10 is developed by the image developer with a developer to form a toner image, the toner image is transferred onto the intermediate transfer belt 50 with a transfer bias applied from the roller 51, and is further transferred onto the transfer paper 95 after charged by the corona charger 52. A residual toner remaining on the photoconductor 10 is removed by the cleaner 60, and the photoconductor 10 is once discharged by the discharge lamp 70.

Figure 2:
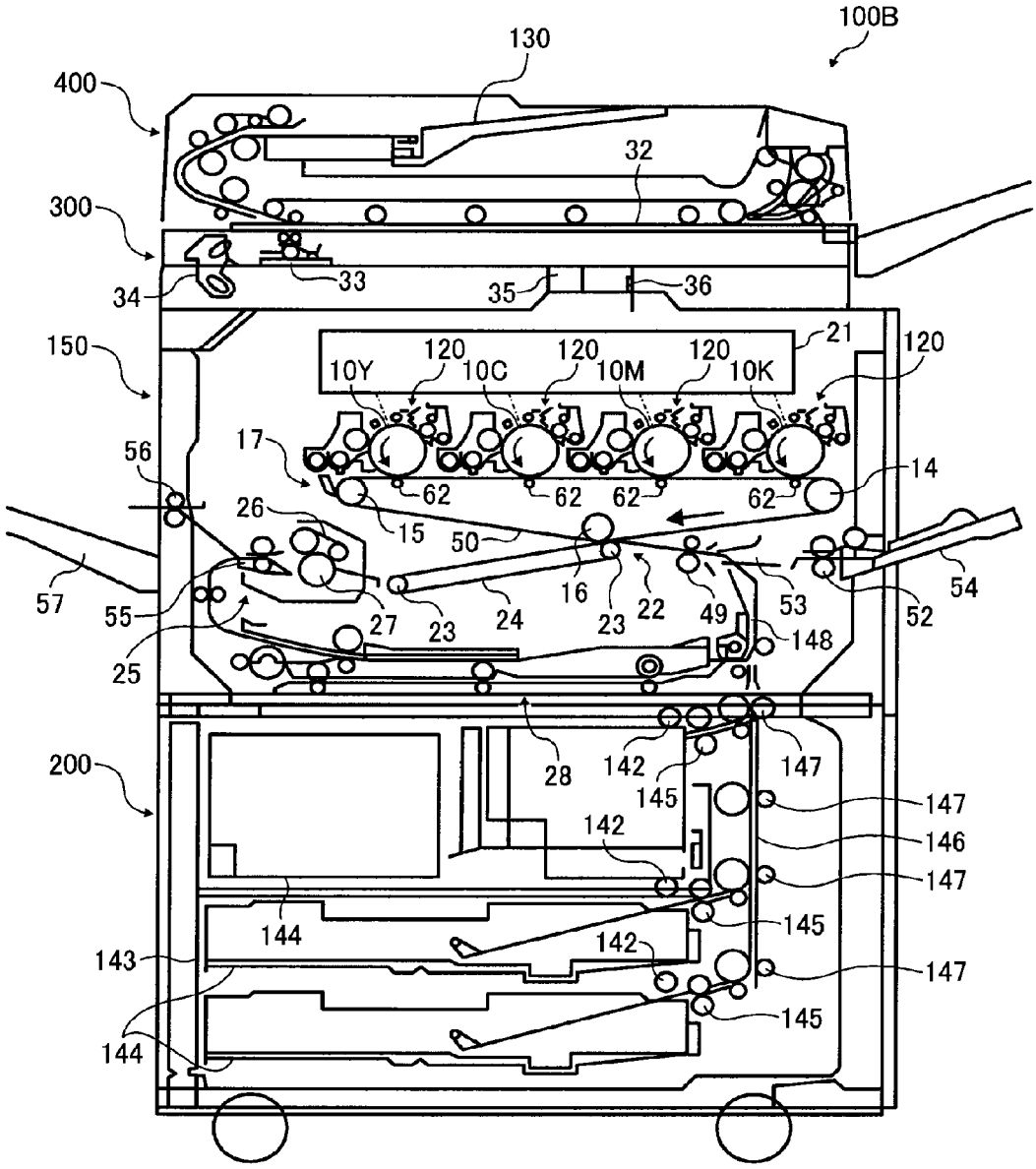
FIG. 2 is a schematic view illustrating another embodiment of the image forming apparatus of the present invention.

FIG. 2 is a schematic view illustrating another embodiment of the image forming apparatus of the present invention.

An image forming apparatus 100B is a tandem color image forming apparatus including a copier main body 150, a paper feeding table 200, a scanner 300, and an automatic document feeder (ADF) 400.

An intermediate transfer belt 50 is disposed at a central part of the copier main body 150.

The intermediate transfer belt 50 is stretched around support rollers 14, 15, and 16, and can rotate in an arrow direction.

Near the support roller 15, an intermediate transfer belt cleaner 17 is disposed in order to remove a residual toner remaining on the intermediate transfer belt 50. Along a conveying direction of the intermediate transfer belt 50 stretched around the support roller 14 and the support roller 15, four image forming units 120 of yellow, cyan, magenta, and black are arranged in parallel so as to face the intermediate transfer belt 50.

Figure 3:
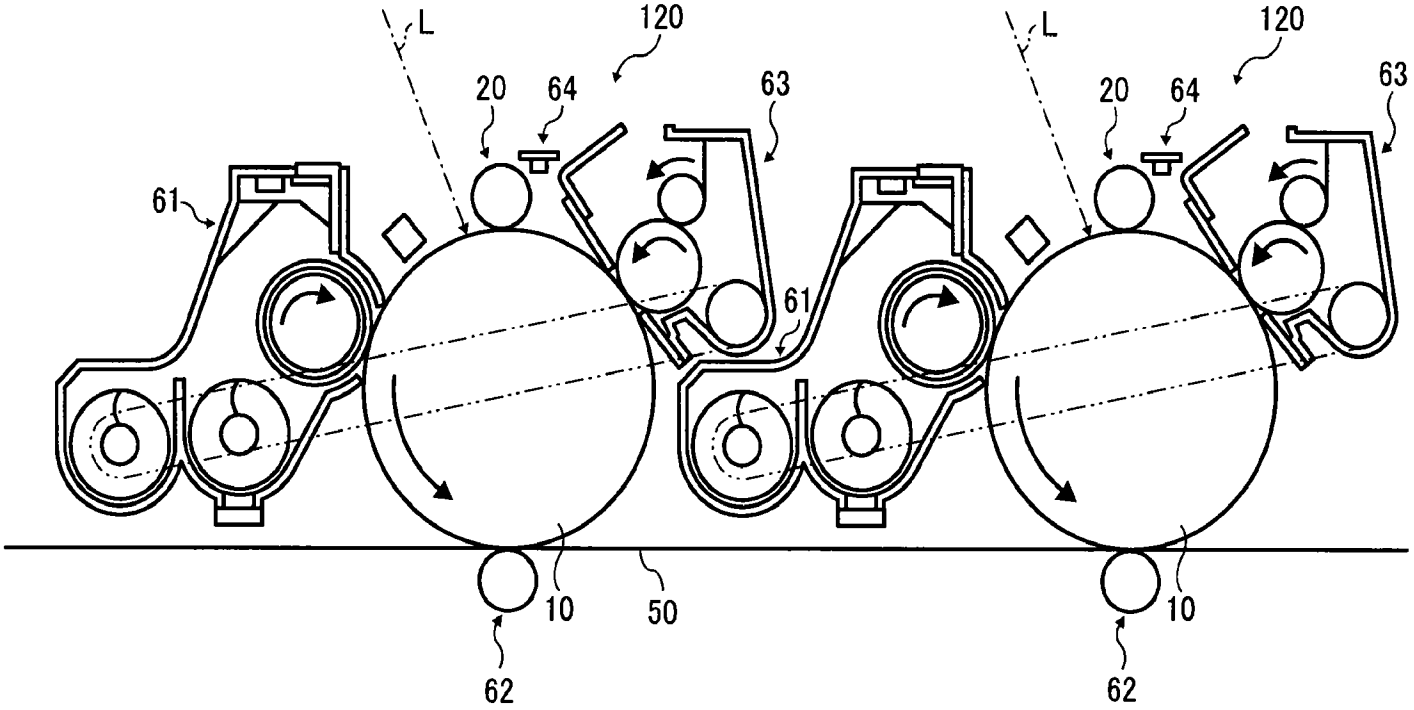
FIG. 3 is a partially enlarged view of the image forming apparatus in FIG. 2.

Each of the image forming units 120 includes, as FIG. 3 shows, a photoconductor drum 10, a charging roller 20 uniformly charging the photoconductor drum 10, an image developer 61 developing the electrostatic latent image formed on the photoconductor drum 10 with each of color toners (black toner, yellow toner, magenta toner, and cyan toner) to form a toner image of each of the color toners, a transfer charger 62 transferring the toner image onto the intermediate transfer belt 50, a cleaner 63; and a discharge lamp 64.

Near the image forming unit 120, an irradiator (not illustrated) is disposed. The irradiator irradiates the photoconductor drum 10 with light L to form an electrostatic latent image.

Further, a transferer 22 is disposed on a side of the intermediate transfer belt 50 opposite to a side where the image forming unit 120 is disposed. The transferer 22 is a transfer belt 24 stretched around a pair of rollers 23. The recoding paper conveyed on the transfer belt 24 and the intermediate transfer belt 50 can contact each other.

Near the transferer 22, a fixer 25 is disposed. The fixer 25 includes a fixing belt 26 and a pressure roller 27 pressed against the fixing belt 26.

A reverser 28 reversing the recording paper is disposed near the transferer 22 and the fixer 25 to form an image on both sides of the recording paper.

Next, a full-color image formation in the image forming apparatus 100B is explained.

Next, a method for forming a full-color image (color-copying) using the tandem type developing device 120 will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed. When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, light is irradiated from a light source in the first travelling body 33, the light reflected from a surface of the document is reflected by a mirror in the second travelling body 34 and then is received by a reading sensor 36 through an imaging forming lens 35. Thus, the color document (color image) is read to thereby form black, yellow, magenta and cyan image information.

Further, after an electrostatic latent image of each color is formed on the photoconductor 10 on the basis of image information of each color obtained from the irradiator, the electrostatic latent image of each color is developed with a developer fed from the image forming unit 120 of each color to form a toner image of each color. The toner image of each color is sequentially transferred onto an intermediate transfer belt 50 rotated by rollers 14, 15 and 16 while overlapped to form a composite toner image.

Meanwhile, on the paper feeding table 200, one of paper feeding rollers 142 is selectively rotated to feed a recording paper from one of the paper feeding cassettes 144 equipped in multiple stages in a paper bank 143. The sheet is separated one by one by a separation roller 145 and sent to a paper feeding path 146. The recording paper is conveyed by a conveying roller 147 and is guided to a paper feeding path 148 in the copying device main body 150, and stops by colliding with a registration roller 49. Alternatively, a paper feeding roller 142 is rotated to feed a recording paper on a manual feed tray 54. The recording paper is separated one by one by a separation roller 52 and is guided to a manual paper feeding path 53, and stops by colliding with the registration roller 49. Notably, the registration roller 49 is generally used while grounded, but it may also be used in a state that a bias is being applied for removing paper dust on the sheet.

Next, by rotating the registration roller 49 in accordance with the timing of the composite toner image formed on the intermediate transfer belt 50, the recording paper is fed between the intermediate transfer belt 50 and a secondary transferer 22. Thereby, the composite toner image is transferred onto the recording paper.

The recording paper on which the color image has been transferred is conveyed by the secondary transferer 22, and then conveyed to the fixer 25. In the fixer 25, the composite color image is heated and pressed by a fixing belt 26 and a pressure roller 27 to be fixed on the recording paper. Next, the recording paper is switched by a switching claw 55, and discharged by a discharge roller 56 and stacked in a paper ejection tray 57.

Notably, a residual toner remaining on the intermediate transfer belt 50 after the composite toner image is transferred is removed by a cleaner 17.

Figure 4:
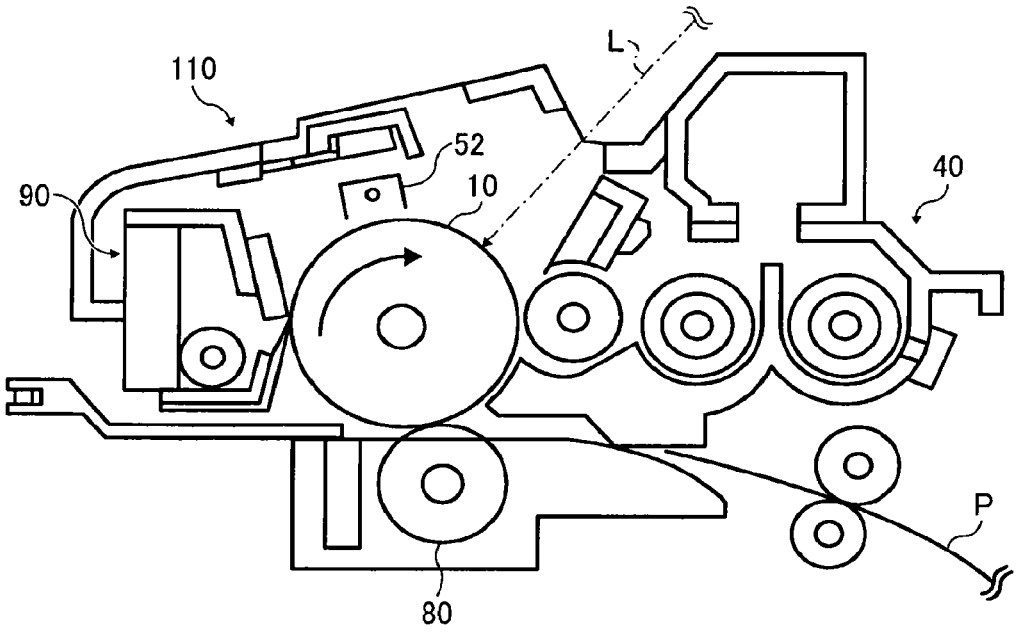
FIG. 4 is a schematic view illustrating an embodiment of the process cartridge of the present invention.

FIG. 4 is a schematic view illustrating an embodiment of the process cartridge of the present invention.

A process cartridge 110 includes a photoconductor drum 10, a corona charging device 52, a developing device 40, a transfer roller 80, and a cleaner 90.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts or %, unless otherwise specified.

(Synthesis of Ketimine 1)

A reaction container equipped with a stirring rod and a thermometer was charged with 170 parts of isophorone diisocyanate and 75 parts of methyl ethyl ketone, followed by reaction at 50° C. for 5 hours, to thereby obtain ketimine 1. The ketimine 1 had an amine value of 418 mg KOH/g.

(Synthesis of Amorphous Polyester A-1)

A reaction vessel equipped with a condenser, a stirrer, and a nitrogen-introducing tube was charged with 3-methyl-1, 5-pentanediol, adipic acid and trimellitic acid anhydride so that a ratio by mol of hydroxyl group to carboxyl group was 1.5. One thousand (1,000) ppm of titanium tetraisopropoxide were added to total monomers such that the content of the trimellitic acid anhydride therein was 1% by mol. Thereafter, the resultant mixture was heated to 200° C. for about 4 hours, then was heated to 230° C. for 2 hours, and was allowed to react until no flowing water was formed. Thereafter, the reaction mixture was allowed to further react for 5 hours under a reduced pressure of 10 to 15 mmHg, to thereby obtain an amorphous polyester having a hydroxyl group.

Next, a reaction vessel equipped with a condenser, a stirrer, and a nitrogen-introducing tube was charged with the amorphous polyester having a hydroxyl group and isophorone diisocyanate at a ratio by mol of isocyanate group to hydroxyl group of 2.0. The resultant mixture was diluted with ethyl acetate, followed by reacting at 100° C. for 5 hrs, to thereby obtain a 50% ethyl acetate solution an amorphous polyester prepolymer A-1.

The obtained 50% ethyl acetate solution an amorphous polyester prepolymer A-1 was stirred in a reaction vessel equipped with a heater, a stirrer, and a nitrogen-introducing tube. The ketimine 1 was added dropwise to the reaction vessel in such an amount that a molar ratio of amino group to isocyanate group was 1. The reaction mixture was stirred at 45° C. for 10 hrs, and then dried at 50° C. under a reduced pressure until an amount of the remaining ethyl acetate was 100 ppm or less, to thereby obtain an amorphous polyester A-1. The amorphous polyester A-1 had a glass transition temperature of −55° C. and a weight-average molecular weight (Mw) of 130,000.

(Synthesis of Amorphous Polyester A-2)

The procedure for preparation of the amorphous polyester A-1 was repeated except for replacing 3-methyl-1, 5-pentanediol with 1, 6-hexanediol and the adipic acid with a mixture of an isophthalic acid and an adipic acid having a molar ratio of the isophthalic acid to the adipic acid of 8/2 to prepare a 50% ethyl acetate solution an amorphous polyester prepolymer A-2 and an amorphous polyester A-2. The amorphous polyester A-2 had a glass transition temperature of −5° C. and a weight-average molecular weight (Mw) of 120,000.

(Synthesis of Amorphous Polyester A-3)

The procedure for preparation of the amorphous polyester A-1 was repeated except for replacing the adipic acid with a decanedioic acid to prepare a 50% ethyl acetate solution an amorphous polyester prepolymer A-3 and an amorphous polyester A-3. The amorphous polyester A-3 had a glass transition temperature of −65° C. and a weight-average molecular weight (Mw) of 100,000.

(Synthesis of Amorphous Polyester A-4)

The procedure for preparation of the amorphous polyester A-1 was repeated except for replacing the adipic acid with an isophthalic acid to prepare a 50% ethyl acetate solution an amorphous polyester prepolymer A-4 and an amorphous polyester A-4. The amorphous polyester A-4 had a glass transition temperature of 5° C. and a weight-average molecular weight (Mw) of 120,000.

Properties of the amorphous polyesters A-1 to A-4 are shown in Table 1.

TABLE 1

| Amorphous Polyester | Diol | Dicarboxylic acid | Glass Transition Temperature [° C.] | Weight-Average Molecular Weight |
|---|---|---|---|---|
| A-1 | 3-methyl-1,5-pentanediol | Adipic Acid | −55 | 130000 |
| A-2 | 1,6-hexanediol | Isophthalic Acid/Adipic acid (80/20) | −5 | 120000 |
| A-3 | 3-methyl-1,5-pentanediol | Decanedioic Acid | −65 | 100000 |
| A-4 | 3-methyl-1,5-pentanediol | Isophthalic Acid | 5 | 120000 |

In Examples and Comparative Examples mentioned later, the amorphous polyesters A-1 to A-4 are thought to be produced in the base particles.

(Synthesis of Amorphous Polyester B)

A reaction vessel equipped with a nitrogen-introducing tube, a dehydration tube, a stirrer, and a thermocouple was charged with bisphenol A ethylene oxide 2 mole adduct (BisA-EO), bisphenol A propylene oxide 2 mole adduct (BisA-PO), a terephthalic acid and an adipic acid. Then, a molar ratio of BisA-EO to BisA-PO was 40/60, a molar ratio of the terephthalic acid to the adipic acid was 93/7 and a molar ratio of a hydroxyl group to a carboxyl group was 1.2, and 500 ppm of titanium tetraisopropoxide were added to total monomers. The resultant mixture was allowed to react under normal pressure at 230° C. for 8 hrs and then to further react under a reduced pressure of 10 mmHg to 15 mmHg for 4 hrs. Then, a trimellitic anhydride was added to total monomers so that an amount thereof was 1% by mol, followed by reacting at 180° C. for 3 hrs, to thereby obtain an amorphous polyester B. The amorphous polyester B had a glass transition temperature of 67° C. and a weight-average molecular weight (Mw) of 10,000.

(Synthesis of Crystalline Polyester C-1)

A reaction vessel equipped with a nitrogen-introducing tube, a dehydration tube, a stirrer, and a thermocouple was charged with sebacic acid and 1, 6-hexanediol so that a ratio by mol of hydroxyl group to carboxyl group was 0.9. Five hundred (500) ppm of titanium tetraisopropoxide were added to total monomers, and the resultant mixture was allowed to react at 180° C. for 10 hrs, heated to 200° C., allowed to react 3 hrs, and then to further react under a pressure of 8.3 kPa for 2 hrs to thereby obtain a crystalline polyester C-1. The crystalline polyester C-1 had a glass transition temperature of 67° C. and a weight-average molecular weight (Mw) of 25,000.

(Synthesis of Crystalline Polyester C-2)

The procedure for preparation of the crystalline polyester C-1 was repeated except for replacing the 1, 6-hexanediol with ethylene glycol to prepare a crystalline polyester C-2. The crystalline polyester C-2 had a glass transition temperature of 78° C. and a weight-average molecular weight (Mw) of 20,000.

<Melting Point and Glass Transition Temperature>

A melting point and a glass transition temperature were measured by a differential scanning calorimeter Q-200 from TA Instruments, Inc. Specifically, an aluminum sample container charged with about 5.0 mg of a sample was placed on a holder unit, and the holder unit is then set in an electric furnace. Next, the sample is heated (first heating) from −80° C. to 150° C. at the heating rate of 10° C./min in a nitrogen atmosphere.

From the obtained DSC curve, using an analysis program stored in the differential scanning calorimeter, a glass transition temperature of the sample was determined.

Similarly from the obtained DSC curve, using an analysis program stored in the differential scanning calorimeter, the endothermic peak top temperature of the sample was determined as a melting point thereof <Weight-Average Molecular Weight>

The weight-average molecular weight was measured by gel permeation chromatography (GPC) measurer GPC-8220GPC from Tosoh Corp and a column TSKgel Super-HZM-H 15 cm Triple from Tosoh Corp. Specifically, the column was stabilized in a heat chamber at 40° C. Next, tetrahydrofuran (THF) was flown in the column at a flow rate of 1 mL/min. Fifty (50) to 200 μl of a THF solution including a sample in an amount of from 0.05% to 0.6% by mass were injected therein to measure a weight-average molecular weight of the sample. From a relation between a logarithmic value and a counter number of a calibration curve prepared by using several monodispersed polystyrene standard samples, a number-average molecular weight of the sample was determined.

As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ from Pressure Chemical Co. or Tosoh Corporation are used.

An RI (refraction index) detector was used as a detector.

Example 1

Preparation of Masterbatch 1

Water (1,200 parts), 500 parts of carbon black (PRINTEX 35, product of Degussa) [DBP oil absorption amount=42 mL/100 mg, pH=9.5], and 500 parts of the amorphous polyester B were added and mixed together by HENSCHEL MIXER (product of NIPPON COKE & ENGINEERING CO., LTD.), and the resultant mixture was kneaded by a two roll mill for 30 min at 150° C. The kneaded product was rolled out and cooled, followed by pulverizing by a pulverizer, to thereby obtain [master batch 1].

<Synthesis of Wax Dispersant 1>

After an autoclave reaction tank equipped with a thermometer and a stirrer was charged with 480 parts of xylene, 100 parts of polyethylene wax 151P having a melting point of 108° C. and a weight-average molecular weight of 1,000 from Sanyo Chemical Industries, Ltd., polyethylene was dissolved and substituted with nitrogen. Next, while a mixed liquid including 805 parts of styrene, 50 parts of acrylonitrile, 45 parts of butyl acrylate, 36 parts of di-t-butylperoxide and 100 parts of xylene was dropped in the solution for 3 hrs, the solution was polymerized at 170° C. and maintained for 30 min. Further, the solvent was removed from the solution to obtain a wax dispersant 1. The wax dispersant 1 had a glass transition temperature of 65° C. and a weight-average molecular weight (Mw) of 18,000.

<Preparation of Wax Dispersion 1>

A vessel to which a stirring bar and a thermometer had been set was charged with 300 parts of paraffin wax HNP-9 from Nippon Seiro Co., Ltd., having a melting point of 75° C., 150 parts of the wax dispersant 1 and 1,800 parts of ethyl acetate, followed by heating to 80° C. during stirring. The temperature was maintained at 80° C. for 5 hrs, followed by cooling to 30° C. in 1 hr. The resultant mixture was dispersed by a beads mill (ULTRA VISCOMILL from AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain a wax dispersion 1.

<Preparation of Crystalline Polyester Dispersion 1>

A vessel to which a stirring bar and a thermometer had been set was charged with 308 parts of the crystalline polyester C-1, 1,900 parts of ethyl acetate, followed by heating to 80° C. during stirring. The temperature was maintained at 80° C. for 5 hrs, followed by cooling to 30° C. in 1 hr. The resultant mixture was dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain a crystalline polyester dispersion 1.

<Preparation of Oil Phase 1>

A vessel was charged with 225 parts of the wax dispersion 1, 40 parts of a 50% ethylacetate solution of the amorphous polyester prepolymer A-1, 390 parts of the amorphous polyester B, 60 parts of the masterbatch 1 and 285 parts of ethylacetate, followed by mixing using a TK Homomixer from PRIMIX Corp. at 7,000 rpm for 60 min, to thereby obtain an oil phase 1.

<Synthesis of Vinyl Resin Dispersion 1>

A reaction vessel equipped with a stirring bar and a thermometer was charged with 683 parts of water, 11 parts of a sodium salt of sulfuric acid ester of methacrylic acid-ethylene oxide adduct ELEMINOL RS-30 from Sanyo Chemical Industries, Ltd., 138 parts of styrene, 138 parts of methacrylic acid, and 1 part of ammonium persulfate, and the resultant mixture was stirred for 15 min at 400 rpm, to thereby obtain a white emulsion. The obtained emulsion was heated to have the system temperature of 75° C., and then was allowed to react for 5 hrs. To the resultant mixture, 30 parts of a 1% ammonium persulfate aqueous solution was added, followed by aging for 5 hrs at 75° C., to thereby obtain an aqueous dispersion liquid of a vinyl resin dispersion 1. The vinyl resin dispersion 1 had a volume-average particle diameter of 0.14 μm.

The volume-average particle diameter of the vinyl resin dispersion 1 was measured by a laser diffraction-scattering type particle diameter distribution measurer LA-920 from HORIBA, Ltd.

<Preparation of Aqueous Phase>

Water (990 parts), 83 parts of the vinyl resin dispersion 1, 37 parts of a 48.5% aqueous solution of sodium dodecyl diphenyl ether disulfonate ELEMINOL MON-7 from Sanyo Chemical Industries Ltd., and 90 parts of ethyl acetate were mixed and stirred, to thereby obtain an opaque white aqueous phase 1.

<Emulsification•Removal of Solvent>

A container including the oil phase 1 was charged with 0.2 parts of the ketimine 1 and 1,200 parts of the aqueous phase 1, and the resultant mixture was mixed by a TK Homomixer at 13,000 rpm for 20 min, to thereby obtain an emulsified slurry 1.

A container equipped with a stirrer and a thermometer was charged with the emulsified slurry 1, followed by removing the solvent therein at 30° C. for 8 hrs. Thereafter, the resultant mixture was aged at 45° C. for 4 hrs, to thereby obtain a dispersion slurry 1.

<Washing•Heating•Drying>

After subjecting 100 parts of the dispersion slurry 1 to filtration under a reduced pressure, the obtained cake was subjected twice to a series of treatments (1) to (4) described below, to thereby produce [filtration cake].

(1): ion-exchanged water (100 parts) was added to the filtration cake, followed by mixing with a TK Homomixer (at 12,000 rpm for 10 min), and then the mixture was filtrated;

(2): one hundred (100) parts of 10% aqueous sodium hydroxide solution were added to the filtration cake obtained in (1), followed by mixing with a TK Homomixer (at 12,000 rpm for 30 min), and then the resultant mixture was filtrated under a reduced pressure;

(3): one hundred (100) parts of 10% by weight hydrochloric acid were added to the filtration cake obtained in (2), followed by mixing with a TK Homomixer (at 12,000 rpm for 10 min) and then the mixture was filtrated; and (4): ion-exchanged water (300 parts) was added to the filtration cake obtained in (3), followed by mixing with a TK Homomixer (at 12,000 rpm for 10 min). The washing processes of from (1) to (4) were repeated twice.

Ion-exchanged water (100 parts) was added to the filtration cake, followed by mixing with a TK Homomixer (at 12,000 rpm for 10 min) and heating at 50° C. for 4 hrs, and then the mixture was filtrated.

Next, the [filtration cake] was dried with an air-circulating drier at 45° C. for 48 hrs, and then was caused to pass through a sieve with a mesh size of 75 μm, to thereby obtain base particles.

One hundred (100) parts of the base particles 1 were mixed with 0.7 parts of hydrophobic silica HDK-2000H having an average particle diameter of 20 nm from Wacker Asahi Kasei Silicone Co., Ltd. and 0.5 parts of hydrophobic titanium oxide having an average particle diameter of 20 nm by a Henschel mixer from NIPPON COKE & ENGINEERING CO., LTD to thereby obtain a toner.

Example 2

The procedure for preparation of the toner in Example 1 was repeated except for changing the quantities of the hydrophobic silica and the hydrophobic titanium oxide into 1.2 parts and 1.0 part, respectively to prepare a toner.

Example 3

Preparation of Oil Phase 2

The procedure for preparation of the oil phase 1 was repeated except for changing the quantities of the 50% ethylacetate solution of the amorphous polyester prepolymer A-1, the amorphous polyester B and the ethyl acetate into 220, 300 and 195 parts, respectively to prepare an oil phase 2.

The procedure for preparation of the toner in Example 2 was repeated except for replacing the oil phase 1 with the oil phase 2 to prepare a toner.

Example 4

Preparation of Oil Phase 3

The procedure for preparation of the oil phase 1 was repeated except for changing the quantities of the 50% ethylacetate solution of the amorphous polyester prepolymer A-1, the amorphous polyester B and the ethylacetate into 50, 385 and 280 parts, respectively to prepare an oil phase 3.

The procedure for preparation of the toner in Example 2 was repeated except for replacing the oil phase 1 with the oil phase 3 to prepare a toner.

Example 5

The procedure for preparation of the toner in Example 4 was repeated except for changing the quantity of the aqueous phase 1 into 1,000 parts to prepare a toner.

Example 6

Preparation of Oil Phase 4

The procedure for preparation of the oil phase 1 was repeated except for changing the quantities of the 50% ethylacetate solution of the amorphous polyester prepolymer A-1, the amorphous polyester B and the ethylacetate into 190, 315 and 210 parts, respectively to prepare an oil phase 4.

The procedure for preparation of the toner in Example 2 was repeated except for replacing the oil phase 1 with the oil phase 4 to prepare a toner.

Example 7

Preparation of Oil Phase 5

The procedure for preparation of the oil phase 3 was repeated except for replacing the 50% ethylacetate solution of the amorphous polyester prepolymer A-1 with a 50% ethylacetate solution of the amorphous polyester prepolymer A-2 to prepare an oil phase 5.

The procedure for preparation of the toner in Example 2 was repeated except for replacing the oil phase 1 with the oil phase 5 to prepare a toner.

Example 8

Preparation of Oil Phase 6

The procedure for preparation of the oil phase 5 was repeated except for changing the quantities of the 50% ethylacetate solution of the amorphous polyester prepolymer A-2, the amorphous polyester B and the ethylacetate into 120, 350 and 245 parts, respectively to prepare an oil phase 6.

The procedure for preparation of the toner in Example 2 was repeated except for replacing the oil phase 1 with the oil phase 6 to prepare a toner.

Example 9

Preparation of Oil Phase 7

A vessel was charged with 225 parts of the wax dispersion 1, 120 parts of a 50% ethylacetate solution of the amorphous polyester prepolymer A-2, 215 parts of the crystalline polyester dispersion 1, 320 parts of the amorphous polyester B, 60 parts of the masterbatch 1 and 60 parts of ethylacetate, followed by mixing using a TK Homomixer from PRIMIX Corp. at 7,000 rpm for 60 min, to thereby obtain an oil phase 7.

The procedure for preparation of the toner in Example 2 was repeated except for replacing the oil phase 1 with the oil phase 7 to prepare a toner.

Example 10

The procedure for preparation of the toner in Example 9 was repeated except for heating the filtration cake for 8 hrs to prepare a toner.

Example 11

The procedure for preparation of the toner in Example 9 was repeated except for heating the filtration cake for 12 hrs to prepare a toner.

Example 12

The procedure for preparation of the toner in Example 9 was repeated except for heating the filtration cake for 24 hrs to prepare a toner.

Example 13

Preparation of Crystalline Polyester Dispersion 2

The procedure for preparation of the crystalline polyester dispersion 1 was repeated except for replacing the crystalline polyester C-1 with the crystalline polyester C-2 to prepare a crystalline polyester dispersion 2.

The procedure for preparation of the toner in Example 13 was repeated except for replacing the crystalline polyester dispersion 1 with the crystalline polyester dispersion 2 to prepare a toner.

Comparative Example 1

Preparation of Oil Phase 8

The procedure for preparation of the oil phase 1 was repeated except for replacing the 50% ethylacetate solution of the amorphous polyester prepolymer A-1 with a 50% ethyl acetate solution of the amorphous polyester prepolymer A-3 to prepare an oil phase 8.

The procedure for preparation of the toner in Example 2 was repeated except for replacing the oil phase 1 with the oil phase 8 and heating the filtration cake for 3 hrs to prepare a toner.

Comparative Example 2

Preparation of Oil Phase 9

The procedure for preparation of the oil phase 1 was repeated except for replacing the 50% ethylacetate solution of the amorphous polyester prepolymer A-1 with a 50% ethylacetate solution of the amorphous polyester prepolymer A-4 to prepare an oil phase 9.

The procedure for preparation of the toner in Example 2 was repeated except for replacing the oil phase 1 with the oil phase 9 to prepare a toner.

Comparative Example 3

The procedure for preparation of the toner in Example 4 was repeated except for changing the quantity of the aqueous phase 1 into 800 parts.

Comparative Example 4

The procedure for preparation of the toner in Example 2 was repeated except for heating the filtration cake for 2 hrs to prepare a toner.

Next, a glass transition temperature determined from a DSC curve of a THF-insoluble component toner when heated for the second time ($Tg_{2nd}$), an average circularity, a BET specific surface area (Bt), a coverage [%] of an external additive (Ct), a number-average particle diameter (Dn) and an average of deformation by microindentation of the toner (X) were measured.

<Content of THF-Insoluble Component>

One (1) part of the toner was added to 40 parts of tetrahydrofuran (THF) and circulated therein for 6 hrs. After an insoluble component was precipitated by a centrifugal separator to separate the insoluble component, the insoluble component was dried at 40° C. for 20 hrs to obtain the THF-insoluble component.

A mass of the THF-insoluble component was measured to determine a content thereof.

<$Tg_{2nd}$ of THF-Insoluble Component>

$Tg_{2nd}$ of the THF-insoluble component was measured by a differential scanning calorimeter (DSC) Q-200 from TA Instruments Japan Inc. Specifically, an aluminum sample container charged with about 5.0 mg of a sample was placed on a holder unit, and the holder unit was then set in an electric furnace. Next, the sample is heated (first heating) from 80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min.

The DSC curve for the second heating was selected from the obtained DSC curves by an analysis program stored in the DSC to thereby determine the Tg of the THF-insoluble component.

<Average Circularity>

An average circularity of the toner was measured by a wet flow type particle image analyzer FPIA-2100 from Toa Medical Electronics Co., Ltd., and analyzed using an analysis software FPIA-2100 Data Processing Program for FPIA version 00-10). Specifically, 0.1 to 0.5 g of the toner and 0.1 to 0.5 ml of a surfactant (alkylbenzenesulfonate Neogen SC-A from Dai-ichi Kogyo Seiyaku Co., Ltd.) having a concentration of 10% by weight were mixed by a micro spatel in a glass beaker having a capacity of 100 ml, and 80 ml of ion-exchange water was added to the mixture. Further, the mixture was dispersed by an ultrasonic disperser UH-50 from STM Corp. at 20 kHz, 50W/10 cm3 for 1 min to prepare a dispersion. The dispersion is further dispersed for totally 5 min to include the particles having a circle-equivalent diameter of from 0.60 to less than 159.21 μm in an amount of 4,000 to 8,000/$10^{-3}$ $cm^3$ and the average circularity thereof was measured.

<Bt>

Bt was measured by an automatic specific surface area/hole distribution measurer (TriStar 3000 from Shimadzu Corp.). A sample occupying about a half of a sample cell was vacuum dried for 24 hrs by a pre-treatment smart prep from Shimadzu Corp. to remove impurities and moisture on the surface of the sample. The pre-treated sample was set in TriStar 3000 to determine a relation between nitrogen gas adsorption quantity and a relative pressure. From this relation, Bt was measured by BET multipoint method.

<Ct>

The toner was observed with a field emission scanning electron microscope (SEM) MERILIN from SII Nano technology Inc. to determine Ct. Specifically, first, a secondary electron image of the toner was obtained. Then, the substrate was a conductive tape to reflect the toner brighter than the substrate, the contrast was selected such that the image had no broken black part or no scattered white part. Next, the obtained image was read by GIMP for Windows® which is an image edit and process software to paint black (R:0, G:0, B:0) the points visually judged to be external additives. Next, the points painted black were digitalized to obtain an areal ratio A thereof relative to the entire image. Further, the original image read by GIMP for Windows® was digitalized with a threshold having suitable brightness to obtain an ratio B of the toner projection image relative to the entire image. A ratio of the external additive area relative to the toner projection image was obtained from a formula A/B, and Ct was defined as the average ratio of 50 toner particles.

Measurement conditions of SEM include, e.g., an accelerated voltage of 3.0 kV and WD (Working Distance) of 10.0 mm.

<Dn>

Dn of the toner was measured by COULTER MULTISIZER II from Beckman Coulter, Inc. First, 0.1 to 5 mL of polyoxyethylenealkylether as a dispersant were added to 100 to 150 mL of an electrolyte solution. The electrolyte was an aqueous solution including 1% of the first grade sodium chloride, such as ISOTON-II (from Beckman Coulter, Inc.). Further, 2 to 20 mg of the toner were added to the electrolyte solution. After electrolyte solution containing the toner was subjected to a dispersion treatment using an ultrasonic disperser for about 1 to 3 min to prepare a suspension, a particle diameter and the number of the toner were measured using a 100-μm aperture.

The following channels were employed during the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Accordingly, particles having a particle diameter not less than 2.00 μm and less than 40.30 μm were subjected to the measurement.

<X>

A deformation of the toner was measured by a microindentation hardness tester ENT-2100 from Elionix Inc.

The apparatus measures a load and a displacement of an indenter when pushed into a sample to obtain a load-displacement curve. The curve measures the toner deformation. Flow of the indentation test is as follows. When the measurement started, the indenter was pushed into the sample at a constant load speed and reached the maximum load. The microindentation test was performed under the following conditions.

Indenter: 20 μm×20 μm flat indenter

Environment: 32° C., 40% RH

Load speed: $3.0\times10^{-5}$N/sec

Maximum load: $3.0\times10^{-4}$N

The number of toners to be measured: 100

Specifically, the toner was placed on a glass substrate and subjected to air blow such that many toners were present independently without being aggregated. A toner to be measured was selected while presence of one particle thereof was observed with a microscope equipped in the apparatus. Then, a long diameter and a short diameter of the toner were measured with a software equipped in the apparatus to only select toners having a long diameter of Dn±0.3 μm to prevent deviation of particle diameters of the toners. When the toner adhered to the indenter after the microindentation test, the toner wiped out with a soft cloth, and then the following measurement was performed after seeing the toner did not remain on the indenter from the load-displacement curve when the indenter was pushed into the substrate.

A deformation of the toner at the maximum load was an average X.

(Preparation of Carrier)

The following materials were mixed and dispersed by a homomixer for 20 min to prepare a protection layer coating liquid. The protection layer coating liquid coating liquid was coated by a fluidized-bed coater on 1,000 parts of spherical magnetite having a particle diameter of 50 μm to prepare a carrier.

| | |
|---|---|
| Silicone resin (organo straight silicone) | 100 |
| Toluene | 100 |
| γ-(2-aminoethyl)aminopropyltrimethoxysilane | 5 |
| Carbon black | 10 |

(Preparation of Developer)

Five (5) parts of each of the toners and 95 parts of the carrier were mixed by a ball mill to prepare developers.

Next, the total energies of the developer in the initial status and after aging test were measured.

<Total Energy>

The total energy was measured using a powder rheometer FT4 from Freeman Technology. Specifically, the developer was filled in a split container until the developer had a height higher than 89 mm. The split container includes a container having an inner diameter of 35 mm, a height of 54 mm and a capacity of 25 mL; and a cylinder having a height of 21 mm separable from the container. Next, an operation (hereinafter referred to as conditioning) of calmly stirring the developer with a propeller-type rotational blade at a tip speed of 60 mm/s and an intrusion angle of 5° was repeated for 16 times. Further, the upper end of the split container was quietly moved to level the developer at a height of 54 mm to obtain the developer filling the 25 mL container. In the conditioning, the rotational blade gently stirred the developer in such a rotational direction not to receive resistance from the developer (anticlockwise from above) so as not to give a stress thereto. Almost all extra air and partial stress were removed to make the developer homogenous. Then, since the rotational blade moved downward as well when rotating, the edge of the rotational blade draws a spiral. An angle of the spiral route drawn by the edge of the rotational blade was an intrusion angle. In order to stably determine the total energy, the conditioning is performed because it is necessary to constantly and stably obtain a powder having a regular volume.

Without inflow of air, the rotational blade was intruded into the developer from a height of 100 mm to a height of 10 mm from the bottom of the 25 mL container at a tip speed of 100 mm/s and an intrusion angle of −5°. Then, a rotational torque and a vertical load were measured and summed to determine a total energy. The rotational blade rotated in a direction reverse to that of the conditioning (clockwise from above). The procedure for determining the above total energy was repeated except for changing the tip speed of the rotational blade to 70 mm/s, 40 mm/s and 10 mm/s. The tip speeds of the rotational blade of 100 mm/s, 70 mm/s and 40 mm/s were so high that the total energy of even the developer considerably deteriorated due to stress is small and deterioration thereof was not sensitively detected. Therefore, the total energy when the tip speed of the rotational blade was 10 mm/s was an index of deterioration of the developer due to stress.

<Aging Test>

Thirty (30) g of the developer was stirred and mixed by a locking mill RM-5S from Seiwa Giken Co., Ltd. at 700 rpm for 60 min to deteriorate.

Properties of the toners and the developers are shown in Tables 2 and 3.

TABLE 2

| | THF-Insoluble component | | | | | | Total Energy [mJ] | |
|---|---|---|---|---|---|---|---|---|
| | $Tg_{2nd}$ [° C.] | Content [mass %] | Average Circularity | Bt [$m^2$/g] | CT [%] | Bt − 0.025 × Ct | Initial | After aging test |
| Example 1 | −45 | 9.1 | 0.95 | 2.76 | 39.2 | 1.78 | 321 | 415 |
| Example 2 | −45 | 9.1 | 0.95 | 3.52 | 69.9 | 1.77 | 326 | 408 |
| Example 3 | −45 | 27.0 | 0.95 | 3.48 | 70.3 | 1.72 | 335 | 429 |
| Example 4 | −45 | 10.4 | 0.95 | 3.49 | 70.1 | 1.74 | 319 | 411 |
| Example 5 | −45 | 10.3 | 0.97 | 3.39 | 70.1 | 1.64 | 310 | 391 |
| Example 6 | −45 | 23.8 | 0.97 | 3.37 | 69.6 | 1.63 | 318 | 400 |
| Example 7 | 2 | 10.7 | 0.97 | 3.32 | 69.2 | 1.59 | 304 | 392 |
| Example 8 | 2 | 16.9 | 0.97 | 3.34 | 70.4 | 1.58 | 293 | 378 |
| Example 9 | 2 | 23.6 | 0.97 | 3.38 | 70.0 | 1.63 | 309 | 402 |
| Example 10 | 2 | 23.9 | 0.97 | 3.02 | 70.7 | 1.25 | 282 | 357 |
| Example 11 | 2 | 23.2 | 0.97 | 2.90 | 69.1 | 1.17 | 256 | 338 |
| Example 12 | 2 | 23.4 | 0.97 | 2.60 | 69.5 | 0.86 | 234 | 260 |
| Example 13 | 4 | 23.3 | 0.97 | 2.65 | 69.6 | 0.91 | 240 | 282 |
| Comparative Example 1 | −52 | 9.4 | 0.95 | 3.50 | 70.4 | 1.74 | 330 | 423 |
| Comparative | 13 | 9.1 | 0.95 | 3.47 | 69.3 | 1.74 | 326 | 417 |

TABLE 2-continued

| | THF-Insoluble component | | | | | | Total Energy [mJ] | |
|---|---|---|---|---|---|---|---|---|
| | $Tg_{2nd}$ [° C.] | Content [mass %] | Average Circularity | Bt [$m^2$/g] | CT [%] | Bt − 0.025 × Ct | Initial | After aging test |
| Example 2 | | | | | | | | |
| Comparative Example 3 | −45 | 8.9 | 0.99 | 3.53 | 69.7 | 1.79 | 316 | 425 |
| Comparative Example 4 | −45 | 9.1 | 0.95 | 3.66 | 70.4 | 1.90 | 356 | 445 |

TABLE 3

| | Dn [μm] | X [μm] | X/Dn |
|---|---|---|---|
| Example 1 | 4.76 | 0.601 | 0.126 |
| Example 2 | 4.88 | 0.610 | 0.125 |
| Example 3 | 4.80 | 0.635 | 0.132 |
| Example 4 | 4.76 | 0.608 | 0.128 |
| Example 5 | 4.84 | 0.609 | 0.126 |
| Example 6 | 4.82 | 0.627 | 0.130 |
| Example 7 | 4.79 | 0.582 | 0.122 |
| Example 8 | 4.81 | 0.585 | 0.122 |
| Example 9 | 4.74 | 0.707 | 0.149 |
| Example 10 | 4.76 | 0.711 | 0.149 |
| Example 11 | 4.80 | 0.691 | 0.144 |
| Example 12 | 4.84 | 0.702 | 0.145 |
| Example 13 | 4.82 | 0.656 | 0.136 |
| Comparative Example 1 | 4.76 | 0.608 | 0.128 |
| Comparative Example 2 | 4.77 | 0.580 | 0.122 |
| Comparative Example 3 | 4.83 | 0.585 | 0.121 |
| Comparative Example 4 | 4.81 | 0.591 | 0.123 |

Next, low-temperature fixability, heat resistant preservability, durability and cleanability of the toner were evaluated.

<Low-Temperature Fixability>

After a modified copier Imagio MF2200 using a Teflon® roller as a fixing roller from Ricoh Company, Ltd. was filled with the developer, images were produced on TYPE 6200 papers while changing the fixing temperature to determine a fixable minimum temperature and evaluate low-temperature fixability. The papers were fed at a linear speed of from 120 to 150 mm/sec, a surface pressure of 1.2 kgf/cm2, and a nip width of 3 mm.

Evaluation criteria of the fixable minimum temperature was as follows.

Excellent: less than 100° C.

Good: not less than 100° C. and less than 110° C.

Fair: not less than 110° C. and less than 120° C.

Poor: not less than 125° C.

(Heat-Resistant Preservability)

After the toner was stored at 50° C. for 8 hrs, the toner was sifted by a sifter having 42 meshes for 2 min. A residual ratio of the toner on the mesh was an indication of the heat-resistant preservability.

Excellent: less than 10%

Good: not less than 10% and less than 20%

Fair: not less than 20% and less than 30%

Poor: not less than 30%

<Durability>

After a digital full-color multifunctional copier Imagio MP C5000 from Ricoh Company, Ltd. was filled with the developer, 500,000 pieces of am images having an image areal ratio of 5% were produced. Next, a solid image was produced to visually observe and evaluate durability.

Excellent: no striped colorless image was produced

Good: striped thin colorless images were slightly produced (less than 5% of the solid image)

Fair: striped thin colorless images were produced (not less than 5% and less than 10% of the solid image)

Poor: many striped thin colorless images were (not less than 10% of the solid image) or striped colorless images were produced.

The durabilities in environments of low temperature and low humidity (10° C. and 15% RH) and high temperature and high humidity (27° C. and 80% RH).

<Cleanability>

Untransferred residual toners after 1,000 pieces of A4-size solid images having a toner adherence amount of 0.5 mg/cm2 were produced by a digital full-color multifunctional copier Imagio MP C5000 from Ricoh Company, Ltd. filled with the developer, and after 100,000 pieces thereof were transferred onto a blank paper using Scotch Tape from Sumitomo 3M Ltd. to measure the densities after 1,000 and 100,000 images were produced with a reflection densitometer RD514 from GretagMacbeth.

Good: a difference in density is less than 0.01

Poor: a difference in density is not less than 0.01

The evaluation results of the low-temperature fixability, heat resistant preservability, durability and cleanability of the toner are shown in Table 4.

TABLE 4

| | Heat-Resistant Preservability | Low-Temperature Fixability | Durability: Low Temperature Low Humidity | Durability: Low Temperature Low Humidity | Cleanability |
|---|---|---|---|---|---|
| Example 1 | Excellent | Fair | Excellent | Good | Good |
| Example 2 | Excellent | Fair | Excellent | Good | Good |
| Example 3 | Good | Good | Excellent | Good | Good |
| Example 4 | Excellent | Good | Excellent | Good | Good |
| Example 5 | Excellent | Good | Excellent | Good | Good |
| Example 6 | Excellent | Good | Excellent | Good | Good |
| Example 7 | Excellent | Good | Excellent | Good | Good |
| Example 8 | Excellent | Good | Excellent | Good | Good |
| Example 9 | Excellent | Excellent | Excellent | Fair | Good |
| Example 10 | Excellent | Excellent | Excellent | Fair | Good |
| Example 11 | Excellent | Excellent | Excellent | Good | Good |
| Example 12 | Excellent | Excellent | Excellent | Good | Good |
| Example 13 | Excellent | Excellent | Excellent | Excellent | Good |
| Comparative Example 1 | Poor | Good | Excellent | Good | Good |
| Comparative Example 2 | Excellent | Poor | Excellent | Good | Good |
| Comparative Example 3 | Excellent | Fair | Excellent | Good | Poor |
| Comparative Example 4 | Excellent | Fair | Fair | Poor | Good |

Table 4 proves each of the toners of Examples 1 to 13 has good low-temperature fixability, heat resistant preservability, durability and cleanability.

The toner of Comparative Example 1 has low heat resistant preservability because $Tg_{2nd}$ of the THF-insoluble component is −52° C.

The toner of Comparative Example 2 has low low-temperature fixability because $Tg_{2nd}$ of the THF-insoluble component is 13° C.

The toner of Comparative Example 3 has low cleanability because of having average circularity of 0.99.

The toner of Comparative Example 4 has low durability because Bt−0.025×Ct is 1.90.

Having now fully described the invention, it will be apparent to one of ordinary skill in the art that many changes and modifications can be made thereto without departing from the spirit and scope of the invention as set forth therein.

What is claimed is:

1. A toner, comprising:

a base particle; and an external additive covering the base particle, wherein the toner includes a tetrahydrofuran-insoluble component wherein the tetrahydrofuran-insoluble component is heated for a first time from −80° C. to 150° C., cooled from 150° C. to −80° C., and then heated for a second time, the tetrahydrofuran-insoluble component having a glass transition temperature determined from a DSC curve when heated for the second time of from −50° C. to 10° C. and an average circularity not greater than 0.98, and satisfies the following relation:

$$Bt-0.025\times Ct\leq 1.80$$

wherein Bt represents a BET specific surface area [$m^2/g$] of the base particles having the external additives; and Ct represents a surface area coverage [%] of the external additive covering the base particle, which is a surface area ratio of the external additive to the surface area of the toner to which the external additive is attached, wherein the toner satisfies the following relation in an environment of 32° C. and 40% RH when a load reaches $3.00\times10^{-4}$N at a load speed of 3.0 $10^{-5}$N/sec:

$$X/Dn\leq 0.14$$

wherein X represents an average of deformation quantity [μm]; and Dn represents a number-average particle diameter [μm].

2. The toner of claim 1, wherein the toner satisfies the following relation:

$$Bt-0.025\times Ct\leq 1.20.$$

3. The toner of claim 1, wherein the tetrahydrofuran-insoluble component comprises an amorphous polyester comprising at least one of a urethane bond and a urea bond.

4. The toner of claim 1, wherein the toner comprises the tetrahydrofuran-insoluble component in an amount of from 5% to 25% by mass.

5. A developer comprising the toner according to claim 1.

6. The developer of claim 5, wherein the developer has a total energy when measured by a powder rheometer in which a container has a capacity of 25 mL, a propeller-shaped rotational blade has a tip speed of 10 mm/s, and an intrusion angle thereof is −5° of from 200 to 350 mJ, wherein 30 g of the developer has the total energy after stirred and mixed by a locking mill at 700 rpm for 60 min of from 200 to 350 mJ.

7. An image forming apparatus, comprising:

a photoconductor;

a charger to charge the photoconductor;

an irradiator to irradiate the photoconductor to form an electrostatic latent image on the photoconductor;

an image developer comprising the developer according to claim 5, to develop the electrostatic latent image with the developer to form a toner image on the photoconductor;

a transferer to transfer the toner image onto a recoding medium; and a fixer to fix the toner image on the recording medium.

8. A process cartridge, comprising:

a photoconductor; and an image developer comprising the developer according to claim 5, to develop an electrostatic latent image with the developer to form a toner image on the photoconductor.

* * * * *